United States Patent [19]

Ground

[11] 4,043,455

[45] Aug. 23, 1977

[54] BENEFICIATION OF FLUORSPAR ORE

[75] Inventor: Ernest R. Ground, Cd. M. Muzquiz, Coahuila, Mexico

[73] Assignee: International Minerals & Chemical Corporation, Libertyville, Ill.

[21] Appl. No.: 734,164

[22] Filed: Oct. 20, 1976

[51] Int. Cl.[2] ..... B03D 1/02

[52] U.S. Cl. ..... 209/167

[58] Field of Search ..... 209/166, 167; 75/2

[56] References Cited

U.S. PATENT DOCUMENTS

| | | | |
|---|---|---|---|
| 2,120,485 | 6/1938 | Clemmer et al. | 209/167 |
| 2,459,219 | 1/1949 | Duke | 209/166 |
| 3,259,242 | 7/1966 | Snow | 209/166 |
| 3,405,802 | 10/1968 | Preller et al. | 209/166 |
| 3,430,765 | 3/1969 | Allen et al. | 209/166 X |
| 3,928,019 | 12/1975 | Marsh | 75/2 |

*Primary Examiner*—Frank W. Lutter
*Assistant Examiner*—Ralph J. Hill
*Attorney, Agent, or Firm*—E. A. Figg; H. E. Post

[57] ABSTRACT

A method is disclosed for beneficiating a fluorspar concentrate containing apatite as a gangue mineral, which includes further concentrating the fluorspar by a froth flotation process wherein the apatite is collected and floated with a cationic reagent in an acid flotation circuit and the fluorspar is depressed with fluoride ions.

8 Claims, No Drawings

BENEFICIATION OF FLUORSPAR ORE

BACKGROUND OF THE INVENTION

The present invention relates to a method for beneficiating a fluorspar concentrate. More particularly, the invention relates to a method for beneficiating a fluorspar concentrate containing apatite as a gangue mineral, by a froth flotation process.

Fluorspar ore commonly contains fluorspar ($CaF_2$), silica, calcite, clay minerals, and, in certain instances appreciable quantitites of the mineral, apatite ($Ca_5(PO_4)_3(F,OH)$). In the production of commercial grades of ore, such as acid-grade fluorspar, it is necessary to concentrate the fluorspar and remove substantial quantities of the gangue materials. For instance, specifications for acid-grade fluorspar currently call for about 97% $CaF_2$ with less than about 1.5% $SiO_2$ and less than about 0.2%, and sometimes as low as, 0.06% apatite calculated as $P_2O_5$.

Conventional concentration techniques, such as gravity concentration and flotation are used to reduce common gangue minerals to acceptable levels. Because of the similar flotation characteristics of fluorspar and apatite, it is difficult to reduce the apatite content of fluorspar concentrates to a tolerable level. Marsh, G. B., U.S. Pat. No. 3,928,019, has disclosed a method for depressing apatite in the flotation of a fluorspar concentrate utilizing, as a depressant, a reagent obtained by mixing a solution containing complexed polyvalent metal cations with an alkali metal silicate to form a hydrosol. Marsh reports that his method is useful for reducing the apatite content to a concentration of about 1.0 wt.% calculated as $P_2O_5$ (2.3 wt.% $Ca_5F(PO_4)_3$).

SUMMARY OF THE INVENTION

An object of this invention is to provide a method for beneficiating a fluorspar concentrate. Another object is to provide a method for beneficiating a fluorspar concentrate, containing apatite as a gangue mineral, by a froth flotation process to provide acid-grade fluorspar. Further objects and advantages will be apparent to those skilled in the art from the disclosure herein.

In accordance with the invention, there is disclosed a method for beneficiating a fluorspar concentrate, containing apatite as a gangue mineral, which includes further concentrating the fluorspar by a froth flotation process utilizing an acid flotation circuit, the improvement, which comprises adding an apatite-collecting cationic reagent to the flotation circuit to collect and float substantially all of the apatite;

adding a source of fluoride ions to the flotation circuit to depress the fluorspar;

removing the apatite by flotation; and recovering the fluorspar from the underflow.

DETAILED DESCRIPTION OF THE INVENTION

The method of the present invention is advantageously employed to upgrade a fluorspar concentrate which has been prior treated to remove all or most of the common gangue constituents, but which still contains unacceptable quantities of apatite. Such treatment methods are generally known in the art and usually include grinding and classifying the ore, concentrating the fluorspar in the comminuted ore by gravity concentration, and further concentration by one or more flotation steps. Such flotation steps frequently involve the use of anionic flotation reagents such as fatty acids or petroleum based compounds as flotation reagents. When the concentrate is to be subjected to the method of the present invention, however, it is preferred that the prior concentration steps do not involve the use of any reagent which forms a coating on the ore particles which is impervious to a cationic reagent or fluoride ions. In this regard, it has been found that the use of petroleum products, such as kerosene, is contraindicated, and only substantially unsaturated fatty acids should be employed.

For similar reasons, high conditioning temperatures, e.g. greater than about 75° C should be avoided. Such conditions have been shown to produce an insoluble surface coating on the ore particles, which is deleterious to the practice of the present method.

Should a deleterious coating of the ore concentrate particles be present, a scrubbing step may be included. The term "scrubbing" as used in the wet mineral processing art means agitation of solids in slurry form, generally employing a solids content of about 45% to about 75% solids. The scrubbing liquid may be water, or, preferably, contains an agent selected to aid in the removal of previously used processing chemicals. The manner of conducting the scrubbing step, and of selecting scrubbing agents is generally known by those skilled in the art. In the present method, an acidic scrubbing solution, e.g. one containing a mineral acid such as sulfuric or hydrochloric acid, may advantageously be employed to clean the ore concentrate.

In practicing the method of the present invention, a concentrate is first preferably conditioned with fluoride ions in an acid solution. Such conditioning may consist of treatment of the ore with fluoride ions at a pH of from about 2.8 to about 3.1 for at least about 4–5 minutes. Any suitable mineral acid, such as sulfuric acid, hydrochloric acid, nitric acid, etc. may be used for controlling the pH. Hydrofluoric acid may be advantageously employed both as the source of fluoride ions and for lowering the pH. Following such conditioning, the ore is subjected to froth flotation employing any of the standard flotation equipment known to the art. It will be apparent that a battery of units in parallel or in series may be employed for the flotation. The number of stages of flotation to which the ore is subjected, the retention time in each cell, the temperature of the pulp, and other conditions depend on the characeteristics of the ore and the desired purity of the concentrate. The determination of these parameters is within the ability of one skilled in the wet mineral processing art. The concentrate is reagentized employing any suitable reagentizing procedure and any suitable apatite-collecting cationic or positive ion flotation agent. Many of such reagentizing procedures and reagents are known in the art. The cationic reagent is selected and used in an amount sufficient to collect and float substantially all of the apatite present in the pulp. Suitable cationic reagents include the higher aliphatic amines and their salts with water-soluble acids; the esters of amino alcohols with high molecular weight fatty acids and their salts with water-soluble acids; the higher alkyl-O-substituted isoureas and their salts with water-soluble acids; the higher aliphatic quaternary ammonium bases and their salts with water-soluble acids; the reaction product of polyalkylene polyamines with fatty acids or fatty acid triglycerides; the higher alkyl pyridinium water-soluble acids; the higher quinolinium salts of water-soluble acids; and the like.

The preferred cationic reagents are higher aliphatic amines, e.g. those having from about 6 to 20 carbon atoms, preferably about 8 to 18 carbon atoms. Such amines are advantageously employed at a concentration of about 0.05 lb. to about 1.0 lb., preferably about 0.1 lb. to about 0.5 lb. per ton of finished concentrate.

The fluoride ions are employed at a concentration sufficient to depress the fluorspar and to promote the flotation of the apatite. Any suitable source of fluoride ions may be utilized. For instance, hydrofluoric acid, or water soluble fluoride salts may be used. Hydrofluoric acid may advantageously be employed both as the source of fluoride ions and to maintain a low pH, however, fluoride salts, such as sodium fluoride, potassium fluoride, ammonium fluoride, ammonium bifluoride, etc. may be the economically preferred source of fluoride ions. Fluoride ion concentrations of from about 1 lb. to 7 lb., preferably about 3.5 lb. to 5 lb. of fluorine per ton of fluorspar concentrate are advantageously employed. Fluoride concentations below about 1 lb. per ton of fluorspar concentrate are generally insufficient to depress substantial quantities of fluorspar, and concentrations above about 7 lb. per ton are usually economically disadvantageous.

The pH of the flotation circuit is maintained in a range of from about 2 to about 5, preferably about 3 to 4. The pH may be controlled by the addition of hydrofluoric acid, or, in the event that water-soluble fluoride salts are used as the source of fluoride ions, the pH may be controlled with a suitable mineral acid as hereinbefore described.

The flotation is effective to remove, as an overflow concentrate, a substantial amount of the apatite. The substantially apatite-free fluorspar concentrate is thus recovered in the underflow.

The method, therefore, satisfies the objects and advantages set forth above, in providing an acid-grade fluorspar having a low concentration of apatite.

The invention is further illustrated by the following examples, which are not intended to be limiting.

EXAMPLE I

A composite sample (325 g) of fluorspar ore concentate which had previously been beneficiated by a conventional fatty acid flotation was placed in a standard laboratory flotation cell (Denver Sub A type cell). The concentrate was conditioned in hydrofluoric acid at a pH of from about 3 to 4 for about four minutes. An amine mixture comprising normal aliphatic amines ranging from 8 to 18 carbon atoms was then added to the flotation cell. The pulp was conditioned with the amine for about three minutes, following which the first flotation was made. Samples of the flotation tails and the underflow concentrate were taken for assay. The procedure was repeated for four flotations. Table I sets forth the flotation and reagentizing procedure employed. Table II lists the results of the analyses of the flotation tails and the underflow concentrates. The results indicate that after four flotations, more than 90% of the $P_2O_5$ was rejected from the concentrate, leaving a concentration of $P_2O_5$ of 0.06% in the concentrate.

TABLE I

| | Pulp Temperature 25° C | | | |
|---|---|---|---|---|
| | Time Minutes | pH | HF Addition | Amine Addition |
| Start | 0 | 7.60 | 1320 mg. | |
| Acid Conditioning | 1 | — | | |
| Acid Conditioning | 2 | 3.10 | | |
| Acid Conditioning | 3 | 3.50 | | |
| Acid Conditioning | 4 | 3.80 | | |
| Amine Conditioning | 5 | 3.20 | 60 mg. | 50 mg. |
| Amine Conditioning | 6 | 3.40 | | |
| Amine Conditioning | 7 | 3.00 | 60 mg. | |
| First Flotation | 8 | 3.10 | | |
| First Flotation | 9 | 3.40 | | |
| Amine Conditioning | 10 | 3.10 | 60 mg. | 25 mg. |
| Amine Conditioning | 11 | 3.10 | | |
| Amine Conditioning | 12 | 3.25 | | |
| Second Flotation | 13 | 3.60 | | |
| Second Flotation | 14 | 3.80 | | |
| Amine Conditioning | 15 | 4.00 | | 25 mg. |
| Amine Conditioning | 16 | 3.10 | 60 mg. | |
| Amine Conditioning | 17 | 3.30 | | |
| Third Flotation | 18 | 3.60 | | |
| Third Flotation | 19 | 3.75 | | |
| Amine Conditioning | 20 | 4.00 | | 25 mg. |
| Amine Conditioning | 21 | 4.10 | | |
| Amine Conditioning | 22 | 4.40 | | |
| Fourth Flotation | 23 | 4.50 | | |
| Fourth Flotation | 24 | 4.70 | | |
| Fourth Flotation | 25 | 4.80 | | |
| Fourth Flotation | 26 | 5.10 | | |

TABLE II

| | | Weight Grams | Percent Weight | Percent $P_2O_5$ | Percent of $P_2O_5$ Rejected | Cumulative Percent of $P_2O_5$ Rejected |
|---|---|---|---|---|---|---|
| Heads | | 325 | 100 | 0.46 | 100 | |
| | Flotation Tails | 6.0 | 1.85 | 4.17 | 16.65 | 16.65 |
| First Flotation | | | | | | |
| | Concentrate | 319 | 98.15 | 0.39 | | |
| | Flotation Tails | 10.5 | 3.23 | 7.47 | 52.19 | 68.84 |
| Second Flotation | | | | | | |
| | Concentrate | 308.5 | 94.92 | 0.15 | | |
| | Flotation Tails | 20.0 | 6.15 | 1.06 | 14.11 | 82.95 |
| Third Flotation | | | | | | |
| | Concentrate | 288.5 | 88.77 | 0.09 | | |
| | Flotation Tails | 55.5 | 17.08 | 0.21 | 7.75 | 90.70 |
| Fourth Flotation | | | | | | |
| | Concentrate | 233.0 | 71.69 | 0.06 | 9.30 | |

EXAMPLE II

The experiment of Example I was repeated in all essential details, except 972.5 g of concentrate was used, and the flotation and reagentizing procedure set forth in Table III was employed. The results are listed in Table IV which indicate that after six flotations, more than 92% of the $P_2O_5$ was rejected from the concentrate, leaving a concentration of 0.06% in the concentrate.

TABLE III

| | Pulp Temperature 25° C | | | |
|---|---|---|---|---|
| | Time Minutes | pH | HF Addition | Amine Addition |
| Start | 0 | 7.80 | | |
| Acid Conditioning | 1 | 2.60 | 1800 mg. | |
| Acid Conditioning | 2 | 2.90 | | |
| Acid Conditioning | 3 | 3.50 | | |
| Acid Conditioning | 4 | 4.00 | | |

TABLE III-continued

| | Pulp Temperature 25° C | | | |
|---|---|---|---|---|
| | Time Minutes | pH | HF Addition | Amine Addition |
| Amine Conditioning | 5 | 3.10 | 120 mg. | 50 mg. |
| Amine Conditioning | 6 | 3.30 | 60 mg. | |
| Amine Conditioning | 7 | 3.20 | 60 mg. | |
| First Flotation | 8 | 3.40 | | |
| First Flotation | 9 | 3.80 | | |
| First Flotation | 10 | 3.25 | 60 mg. | 25 mg. |
| Amine Conditioning | 11 | 3.15 | 60 mg. | |
| Amine Conditioning | 12 | 3.20 | 60 mg. | |
| Second Flotation | 13 | 3.40 | | |
| Second Flotation | 14 | 3.80 | | |
| Amine Conditioning | 15 | 3.20 | 60 mg. | 25 mg. |
| Amine Conditioning | 16 | 3.60 | | |
| Amine Conditioning | 17 | 3.00 | 60 mg. | |
| Third Flotation | 18 | 3.45 | | |
| Third Flotation | 19 | 3.80 | | |
| Amine Conditioning | 20 | 3.20 | 60 mg. | 25 mg. |
| Amine Conditioning | 21 | 3.55 | | |
| Amine Conditioning | 22 | 3.20 | 60 mg. | |
| Fourth Flotation | 23 | 3.35 | | |
| Fourth Flotation | 24 | 3.60 | | |
| Amine Conditioning | 25 | 3.20 | 60 mg. | 25 mg. |
| Amine Conditioning | 26 | 3.50 | | |
| Amine Conditioning | 27 | 3.70 | | |
| Fifth Flotation | 28 | 3.85 | | |
| Fifth Flotation | 29 | 4.00 | | |
| Amine Conditioning | 30 | 3.20 | 60 mg. | 25 mg. |
| Amine Conditioning | 31 | 3.50 | | |
| Amine Conditioning | 32 | 3.70 | | |
| Sixth Flotation | 33 | 3.90 | | |
| Sixth Flotation | 34 | 4.10 | | |
| Sixth Flotation | 35 | 4.20 | | |
| Sixth Flotation | 36 | 4.45 | | |

TABLE IV

| | | Weight Grams | Percent Weight | Percent $P_2O_5$ | Percent of $P_2O_5$ Rejected | Cumulative Percent of $P_2O_5$ Rejected |
|---|---|---|---|---|---|---|
| Heads | | 972.5 | 100 | 0.52 | 100 | |
| | Flotation Tails | 15.0 | 1.54 | 2.67 | 7.89 | 7.89 |
| First Flotation | | | | | | |
| | Concentrate | 957.5 | 98.46 | 0.49 | | |
| | Flotation Tails | 18.0 | 1.88 | 4.28 | 15.17 | 23.06 |
| Second Flotation | | | | | | |
| | Concentrate | 939.50 | 96.61 | 0.42 | | |
| | Flotation Tails | 29.0 | 3.09 | 5.27 | 30.10 | 53.16 |
| Third Flotation | | | | | | |
| | Concentrate | 910.50 | 93.62 | 0.26 | | |
| | Flotation Tails | 41.00 | 4.50 | 3.02 | 24.38 | 77.54 |
| Fourth Flotation | | | | | | |
| | Concentrate | 869.50 | 89.41 | 0.13 | | |
| | Flotation Tails | 64.0 | 7.36 | 0.73 | 9.20 | 86.74 |
| Fifth Flotation | | | | | | |
| | Concentrate | 805.50 | 82.83 | 0.08 | | |
| | Flotation Tails | 158.5 | 19.68 | 0.18 | 5.62 | 92.36 |
| Sixth Flotation | | | | | | |
| | Concentrate | 647.0 | 66.52 | 0.06 | 7.64 | |

EXAMPLE 3

The experiment of Example 1 is repeated in all essential details except 2-amino-1-propyl oleate is substituted for the amine mixture, ammonium fluoride is used as the source of fluoride ions, and the pH is controlled with concentrated sulfuric acid. The experiment should be effective for removing $P_2O_5$ values from the fluorspar concentrate.

1. In a method for beneficiating a fluorspar concentrate, containing apatite as a gangue mineral, which includes further concentrating the fluorspar by a froth flotation process utilizing an acid flotation circuit, the improvement, which comprises adding an apatite-collecting cationic reagent to the flotation circuit to collect and float substantially all of the apatite;

adding a source of fluoride ions to the flotation circuit to depress the fluorspar;

removing the floated apatite; and recovering the fluorspar from the underflow.

2. The method of claim 1 wherein the cationic reagent is selected from the group consisting of higher aliphatic amines and their salts with water-soluble acids; esters of amino alcohols with high molecular weight fatty acids and their salts with water-soluble acids; higher alkyl-O-substituted isoureas and their salts with water-soluble acids; higher aliphatic quaternary ammonium bases and their salts with water-soluble acids; reaction products of polyalkylene polyamines with fatty acids or fatty acid triglycerides; higher alkyl pyridinium water-soluble acids; and higher quinolinium salts of water-soluble acids; and the cationic reagent is employed in an amount sufficient to collect and float substantially all of the apatite; and the source of fluoride ions is employed in an amount sufficient to depress substantially all of the fluorspar, and the pH is controlled in a range of from about 2 to about 5.

3. The method of claim 2 wherein the source of fluoride ions is hydrofluoric acid.

4. The method of claim 2 wherein the source of fluoride ions is a water-soluble fluoride salt.

5. The method of claim 4 wherein the water-soluble fluoride salt is selected from the group consisting of sodium fluoride, potassium fluoride, ammonium fluoride, and ammonium bifluoride.

6. The method of claim 4 wherein the pH is controlled with a mineral acid selected from the group consisting of sulfuric acid, hydrochloric acid, and nitric acid.

7. The method of claim 2 wherein the cationic reagent is an aliphatic amine of from about 6 to about 20 carbon atoms, and is employed at a concentration of from about 0.05 lb. to about 1.0 lb. per ton of concentrate, the source of fluoride ions is employed in an amount sufficient to provide from about 1 lb. to about 7 lb. of fluorine per ton of concentrate, and the pH is controlled in a range of from about 3 to about 4.

8. The method of claim 2 wherein the cationic reagent is an aliphatic amine of from about 8 to about 18 carbon atoms, and is employed at a concentration of from about 0.1 lb. to about 0.5 lb. per ton of ore, the source of fluoride ions is employed in an amount sufficient to provide from about 3.5 lb. to about 5 lb. of fluorine per ton of concentrate, and the pH is controlled in a range of from about 3 to about 4.

* * * * *